United States Patent [19]

Sanders

[11] Patent Number: 4,516,935

[45] Date of Patent: May 14, 1985

[54] ARRANGEMENT FOR HEATING AND/OR HEAT RETAINING OF CONTAINERS

[76] Inventor: Gerhard Sanders, Silberstr. 1, 7570 Baden-Baden, Fed. Rep. of Germany

[21] Appl. No.: 517,358

[22] Filed: Jul. 25, 1983

[30] Foreign Application Priority Data

Jul. 23, 1982 [DE] Fed. Rep. of Germany ..... 3227504

[51] Int. Cl.[3] ..... F27D 1/00

[52] U.S. Cl. ..... 432/247; 432/175

[58] Field of Search ..... 432/175, 179, 180, 181, 432/182, 222, 247; 110/254; 266/138, 158, 155, 166, 175, 242; 165/DIG. 1, 145

[56] References Cited

U.S. PATENT DOCUMENTS

| | | | |
|---|---|---|---|
| 2,618,906 | 11/1952 | Hess | 432/175 |
| 2,913,239 | 11/1959 | Greene | 432/175 |
| 3,473,795 | 10/1969 | Biro | 432/247 |
| 3,528,648 | 9/1970 | Strand | 432/175 |
| 3,529,812 | 9/1970 | Wunning | 432/179 |
| 3,540,710 | 11/1970 | Yamagishi | 432/209 |

*Primary Examiner*—Henry C. Yuen
*Assistant Examiner*—John Kwon
*Attorney, Agent, or Firm*—Michael J. Striker

[57] ABSTRACT

An arrangement for heating and/or heat retaining of containers and their contents, for example ladles to be filled with molten metal, has a burner directed toward the container, a cover for a container opening, and a preheating device for combustion air which if formed as a component of the cover.

24 Claims, 6 Drawing Figures

ARRANGEMENT FOR HEATING AND/OR HEAT RETAINING OF CONTAINERS

BACKGROUND OF THE INVENTION

The present invention relates to an arrangement for heating and/or heat retaining of containers and their contents, for example ladles to be filled with molten metal. More particularly, it relates to an arrangement of this type which has an air-fuel mixture burner directed toward the interior of the container, a cover for a container opening, and a preheating device for combustion air.

Arrangements of this type are known in the art. The cover for the container opening is composed usually of a plate which is lined at its side facing the container interior with a refractory material. The burner is located in the center of this plate. The smoke gas generated during combustion escapes through the annular gap between the container opening and the cover plate. In addition to strong air contamination and heating and connected therewith poor working conditions, such an arrangement is not satisfactory in the sense of energy consumption. Since the container which accommodates the molten metal has a relatively thick refractory lining which possesses a considerable heat-accumulating capacity, the refractory lining must be supplied before filling of the metal into the container with a considerable quantity of heat energy so as to prevent strong cooling of the molten metal as a result of the temperature equalization between the refractory lining and metal. In correspondence with this, low efficiency and considerable energy loss take place in the heating arrangement.

From the field of furnaces it has been known to use recuperators into which the thermal energy of the waste gases is used to supply it to the combustion air and thereby to increase the efficiency of the installation. Such recuperators are mainly placed separately from the furnace, and therefore it is necessary to provide between the furnace and the recuperator expensive pipe conduits for transporting the waste gas and air. Such installations are not only expensive, but also do not provide a very high efficiency, since heat losses take place through the pipe conduits between the furnace and the recuperator.

Burners with small output are also known in which the waste gas is used directly for preheating the combustion air. These arrangements are, however, connected with certain conditions in the sense of control and construction. In burners of greater output, the direct preheating of the combustion air by the waste gas has not been utilized.

SUMMARY OF THE INVENTION

Accordingly, it is an object of the present invention to provide an arrangement for heating and/or heat retaining of containers, which avoids the disadvantages of the prior art.

More particularly, it is an object of the present invention to provide an arrangement for heating and/or preheating of containers which has a compact construction and requires a lower fuel consumption as compared with the known arrangements, with increased combustion power.

In keeping with these objects and with others which will become apparent hereinafter, one feature of the present invention resides, briefly stated, in an arrangement for heating and/or heat retaining of containers in which a preheating device for preheating combustion air forms a component of a cover which covers a container opening.

With the arrangement designed according to the present invention, it combines a preheating device for containers for molten metals with a recuperative system in such a manner that the system forms a compact structural unit which has a high efficiency and at the same time eliminates pipe conduits, and the like.

A known arrangement for heating of containers for molten metals has a cover which is provided at its side facing the container interior with a lining of refractory material. Because of this refractory lining of the inner surface of the cover, the entire arrangement is relatively heavy and expensive, inasmuch as the refractory material must be mounted at the side facing the container and renewed at certain time intervals. In accordance with the applicant's invention, however, the wall of the arrangement, which limits the combustion chamber toward the container opening, forms at least partially a component of one or several cooling passages through which substantially cold combustion air is supplied. Because of these features, for which the individual protection also takes place, two advantageous results are obtained. On the one hand, the combustion air before reaching the burner is strongly heated, and on the other hand the wall facing the combustion chamber, for example a plate, is cooled by the heat exchange so that a refractory lining is no longer necessary.

In accordance with another advantageous feature of the present invention, it is provided that the arrangement of for example circular base contour has a centrally arranged burner provided with a fuel supply which extends normal to the cover, one or several combustion air supply passages provided substantially in the center and normal to the wall which limits the combustion chamber, cooling passages connected with the combustion air supply passages and openings into an annular chamber which is formed at the periphery of the arrangement and communicates via heat exchanger pipes extending through a heat exchange chamber with a combustion air conduit of the burner. The thus designed arrangement can be formed completely rotation-symmetrical. The combustion air is aspirated or blown from above through the center of the arrangement so as to flow first over the inner side of the container opening-covering plate and cool the latter, before it flows through the heat exchange pipes with simultaneous further heating and is then supplied to the burner via the combustion air conduit.

Depending upon the required output for heating a container, the arrangement can operate with full loading or partial loading. In accordance with the invention it is provided that the preheating device is subdivided into several segments, so that in the event of operation with partial loading only certain segments take part in the heat exchange.

With a rotation-symmetrical arrangement, it can be provided that not the entire periphery is occupied by the preheating device, but only certain segments form the heat exchange chamber, whereas the remaining segments are not used. These features provide for a simple adjustment of the arrangement to the desired output. An especial advantage of this feature is that the partial preheating devices provided in the individual segments are manufactured as indivdual pieces and when needed are used in more or less great number in the entire arrangement. During the manufacture it does not make any difference, in the sense of manufacture of the partial heat exchanger devices, whether these parts for the arrangement provide for greater or smaller output. The segment-like subdivision of the arrangement is also advantageous for repairs which are needed in many cases. When a heat exchanger part is damaged in a certain segment, it suffices to exchange only the respective heat exchanger part without dismounting of the entire arrangement.

The inventive arrangement can be formed basically as a direct-stream installation or a counterstream installation. In the arrangement formed advantageously as a counterstream installation, the wall which limits the combustion chamber is provided, advantageously in the region of the center of the wall, with a waste gas inlet opening, a plurality of laterally or upwardly and downwardly offset guiding sheets extend substantially normal to the heat exchange pipes, and above the heat exchange chamber at least one waste gas outlet chamber is formed which connects the peripheral region of the heat exchange chamber with an outlet passage arranged advantageously in the center of the arrangement. The flow path of the combustion air is clear from the above presented description. The waste gas which flows in counterstream to the combustion air travels in the central region of the plate into the inlet opening, then flows under the action of the guiding sheets around the heat exchanger pipes many times, so that the thermal energy is withdrawn via the pipes to the combustion air flowing in the heat exchanger pipes.

The main stream direction is radially outwardly. When the waste gas reaches the marginal region of the arrangement, its thermal energy is withdrawn in greater part and it can be theoretically discharged in the marginal region out of the arrangement. However, for providing a compact construction, the waste gas travels via the waste gas outlet chamber toward the center of the arrangement, and from there is withdrawn via the outlet passage.

A very compact construction and a simple guidance of cold and preheated combustion air in the center of the arrangement is obtained when the fuel supply takes place through a first pipe extending centrally in the arrangement, and a second pipe coaxially surrounds the first pipe and has axially extending segment chambers into which the heat exchanger pipes (advantageously alternating in the circumferential direction) are open and into which cold combustion air is axially supplied from above.

For withstanding high temperatures, and respectively guaranteeing a good cooling of the lower plate, the heat exchanger parts of the arrangement in accordance with the present invention are composed of steel or copper.

Depending upon the cross section of the passages provided for the supply of combustion air, the combustion air flows more or less fast, so that for example in the event of high flow speed of the combustion air cooling of the lower plate cannot be provided when the combustion air moves directly radially on the inner side of the wall or plate. For obtaining a longer dwell time of the cold air in this region and therefore improved cooling of the wall, in the arrangement in accordance with the present invention the cooling passages on the wall limiting the combustion chamber are formed spiral-shaped. This shape of the cooling passages provides for a turbulent air flow which guarantees a very good heat exchange and therefore a good cooling of the cover plate.

It has been shown that the heat exchanger parts of the arrangement for obtaining a high efficiency can be provided without difficulties when the ratio of the height and width, or respectively height and diameter of the preheating device, amounts to from 1:1.5 to 1:3.5, advantageously 1:2. When the burner lies in the plane of the wall or plate which limits the combustion chamber, it is possible that the burner will heat too strongly the surrounding region of the plate. For reliably avoiding this phenomenon, the burner of the inventive arrangement has a part which substantially projects outwardly of the wall which limits the combustion chamber.

In accordance with a further feature of the present invention, a shaped sealing member is provided in the marginal region of the arrangement so as to reliably avoid penetration of cold surrounding air into the prechamber, or escape of the hot air which can be used for preheating of the container into the surrounding atmosphere. By this sealing a further energy economy is obtained, and improved working conditions are provided since the surrounding air is not heated and dirtied.

The burner of the inventive arrangement can be formed as an oil, gas or solid matter burner. When the solid-matter burner is used, it is advantageous to provide an ash and flue dust separator, which guarantees that the operation of the heat exchanger parts are not affected by depositing of ash and flue dust.

In accordance with the present invention, the diameter of the heat exchanger chamber which forms the main component of the preheating device is kept as small as possible, so that this part can be used for ladles or containers having both small and very great diameters. When for a ladle with a small diameter only low combustion power is needed, only one part of the segments of the preheating device forms the heat exchanger parts. For higher power, respectively greater number of segments are used. For closing the combustion chamber, the annular chamber from which somewhat heated combustion air travels into the heat exchange pipes is corespondingly increased. In such a case it is advantageous to continuously use the thermal energy contained in the waste gas. It is known that in heat exchanger arrangements of this type the quantity of the transmitted thermal energy depends not only on the temperature of the waste gas and the surface as well as on the material of the heat exchange pipes, but also on the contact time of the waste gas with the heat exchange pipes. In the beginning of the flow path, the waste gas has left relatively high temperature, so that relatively much heat energy is exchanged. After a certain travel, the waste gas is colder, so that respectively less heat energy is exchanged.

For withdrawing as much thermal energy as possible from the waste gas, it is proposed in accordance with the present invention to form the flow cross section of the heat exchanger chamber for the waste gas increasing in the flow direction. Thereby the dwell or contact time of the waste gas with the heat exchange pipes to the end of the flow path is longer than in the beginning of the flow path. Therefore at the end of the flow path increased heat transmission takes place as compared with the constant flow cross section. The increase of the flow cross section can also be obtained when the distance of the above mentioned guiding sheets is selected greater in flow direction.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
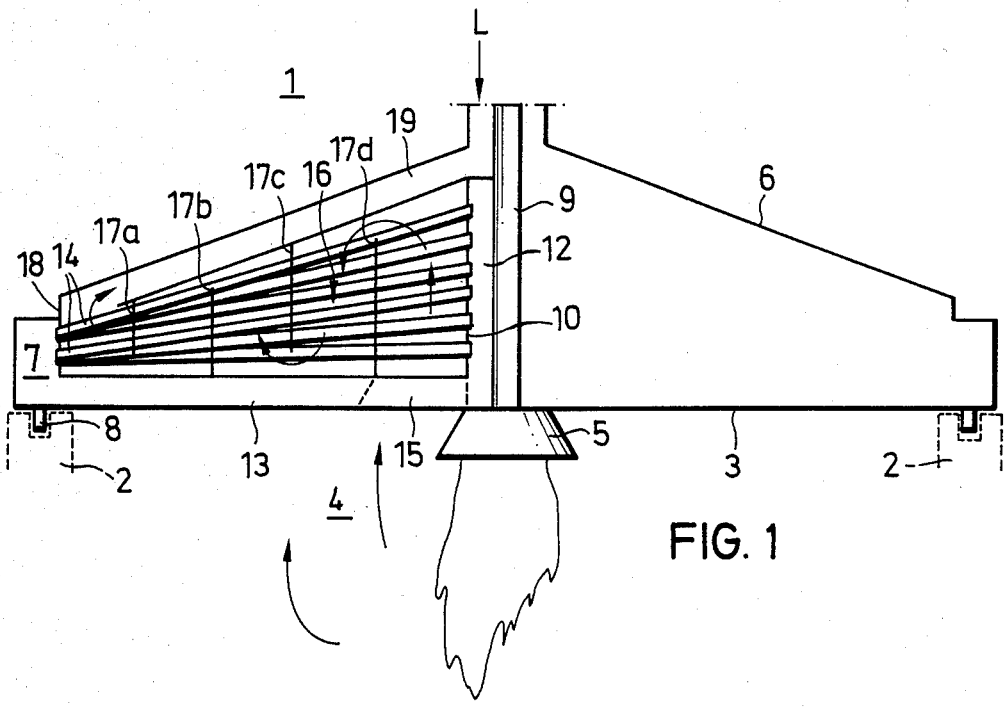
FIG. 1 is a partially sectioned lateral view of an arrangement for heating a ladle to be heated with molten metal.

FIG. 1 shows an arrangement 1 for heating and/or heat retaining of a ladle 2 which is shown partially and identified with broken lines. The ladle 2 is to be filled for example by molten iron. The arrangement 1 has a lower wall which is formed by a plate 3 and together with the ladle 2 forms a combustion chamber 4. The combustion chamber 4 is heated by an oil burner 5.

Figure 2:
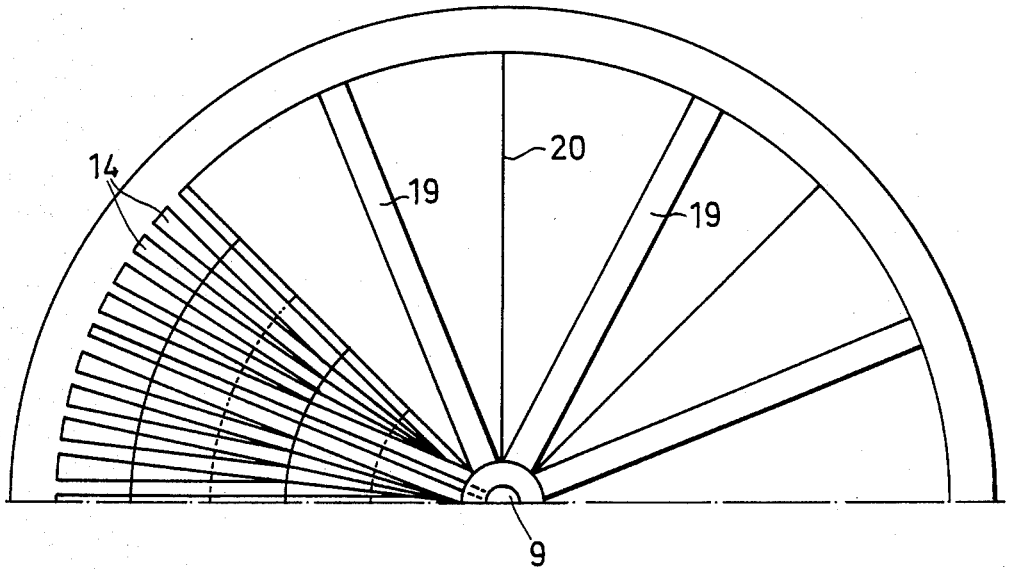
FIG. 2 is a plan view of the partially sectioned arrangement of FIG. 1.

The plate 3 of the arrangement 1 is flat. In contrast an upper side 6 of the arrangement 1 is roof-shaped, as can be seen in FIG. 2. The arrangement has a circular base contour and is provided with an annular chamber 7 extending around this contour. The annular chamber 7 has at its lower side a sealing shaped member 8 which engages in a recess provided at the lower edge of the ladle 2.

Figure 6:
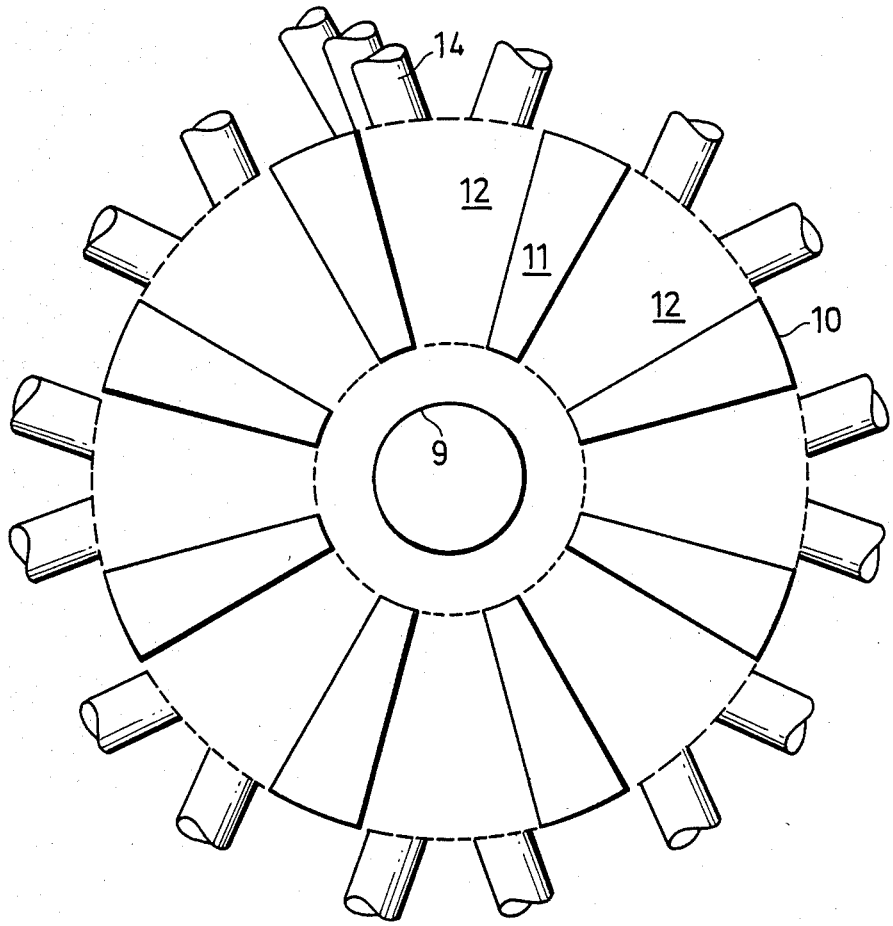
FIG. 6 is a view showing a horizontal section of the central region of the arrangement of FIG. 1.

The fuel supply for the burner 5 takes place via a fuel supply pipe 9 which extends centrally and axially through the arrangement 1. The fuel supply 9 is coaxially surrounded by an air pipe 10. As can be seen from FIG. 6, the air pipes 10 is subdivided in an axial direction into small segment chambers 11 for fresh cold combustion air and larger segment chambers 12 for preheated combustion air. FIG. 1 shows in section a greater segment chamber 12 for preheated combustion air.

The cold combustion air is supplied axially in the direction of the arrow L in FIG. 1 through the small segment chambers 11 into the arrangement 1 and passes through the segment chambers 11, enters radial spiral-shaped (not shown) cooling passages 13, travels substantially preheated into the annular chambers 7 with flowing over and cooling of the cover plate 3 which has been heated by the smoke gas in the combustion chamber 4, and reaches via heat exchanger pipes 14 extending radially to the center, the larger segment chambers 12 of the air pipe 10. The preheated combustion air discharges at the lower end of the segment chambers 12 for combustion.

Figure 5:
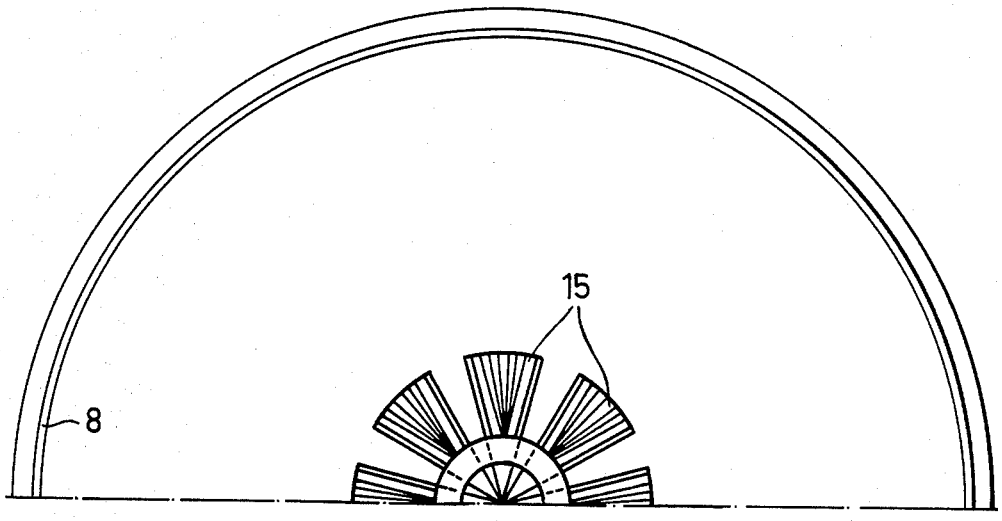
FIG. 5 is a plan view from above of the arrangement shown in FIG. 1 without a burner.

The waste gas whose direction is identified in FIG. 1 with the arrow travels from the combustion chamber 4 into waste gas inlet openings 15 which are arranged in the region of the burner 5 in a circumferential direction with distances therebetween, as can be seen in FIG. 5. From there it flows through a heat exchange chamber 16 formed by the heat exchanger pipes 14. The heat exchange chamber 16 is subdivided by four ring-shaped guiding sheets *17a–17d* which are alternately offset upwardly and downwardly, so that the waste gas flows around the heat exchanger pipes 14 with multiple direction change partially in a counterstream, and partially in a cross counterstream. For the sake of clarity several arrows are provided in FIG. 1, which identify the flow path of the waste gas. In the region of an outer wall 18 of the arrangement 1, the waste gas is deflected upwardly and flows via an outlet chamber 19 into an outlet passage arranged in the center of the arrangement and not shown in the drawing.

Figure 3:
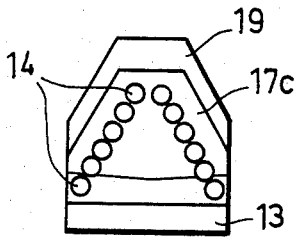
FIG. 3 is a view showing a partial section of a bundle of heat exchange pipes in the region of the innermost guiding sheet of the arrangement.
Figure 4:
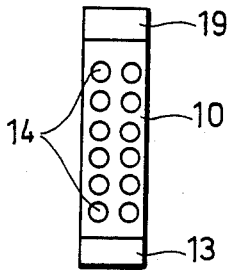
FIG. 4 is a view showing a partial section or a cross sectional development of a bundle of heat exchanger pipes in the region of the center of the arrangement.

As can be particularly seen from FIGS. 1 and 2, the heat exchange pipes 14 are inclined outwardly in a downward direction, so that they have practically substantially the same distances. Thereby the roof-shaped upper side 6 of the arrangement is formed, wherein the outlet chambers 19 form a "ridge" of the roof. Several, for example ten, heat exchange pipes 14 form a group or a pipe bundle. Each of these groups or bundles has a cross section which in the region of the guiding sheet *17c* has the shape of the inverted letter "V" as shown in FIG. 3, and in the region of the air pipe 10 has the shape of two adjacent rows as shown in FIG. 4.

One or several pipe groups or bundles can be assembled with one another in a segment-like manner, so that for operation of the arrangement with partial loading only certain segments take part in the heat exchange. For example, it can be attained in that a radially extending partition 20 shown in FIG. 2 is provided between individual pipe bundles and the inlet openings for the smoke gas are formed closable individually or in groups.

The above described arrangement, particularly its parts which participate in the heat exchange, is composed of heat-resistant material, for example of steel. Copper is also suitable for this purpose, since it is known that copper has high heat conductive properties. The relation of the height of the preheating arrangement, or substantially its heat exchange chamber, to the diameter amounts to approximately 1:2. As can be seen from FIG. 1, the burner 5 extends substantially downwardly beyond the plane of the plate 3. This has the purpose of preventing excessively strong heating of the plate 3 around the burner.

Other embodiments of the present invention are also possible, for example a gas or solid-matter burner can be used. With the use of a solid-matter burner, a separator for ashes and dust is provided, so as to prevent that full functioning of the recuperator part of the arrangement be affected by depositing of these residues.

In the shown embodiment, the drawing of and discharging of the waste gas takes place by a drawing passage or flue provided in the region of the center axis of the arrangement. It is also possible to withdraw the waste gas in the marginal region of the arrangement. In this case several drawing passages are connected with the outer wall 18 or the marginal region of the upper side 6.

It is to be understood that, if needed, the residual heat still remaining in the smoke gas can be further reduced by a subsequently arranged heat exchanger. The cooling passages 13 provided in the region of the plate 3 are formed in the above described embodiment advantageously of spiral shape and have a triangular or wave-shaped cross section. However, it is possible to provide other shapes and cross sections.

The lower plate 3 does not need to be flat. It can be somewhat inclined similarly to the upper side 6. This inclination depends on the arrangement of the heat exchanger pipes inside the heat exchanger chamber.

In the above described embodiment the segment passages 11 and 12 are formed by shaped members welded to the air pipe 10. It is also possible to form these passages by sheets which connect the pipe 10 with the pipe 9.

It will be understood that each of the elements described above, or two or more together, may also find a useful application in other types of constructions differing from the types described above.

While the invention has been illustrated and described as embodied in an arrangement for heating and/or heat retaining of containers and their contents, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. Arrangement for heating and/or heat retaining of containers and their contents, for example ladles to be filled with molten metal, the arrangement comprising a burner arranged to be directed into the interior of the container; a cover for covering a container opening; and a preheating device for preheating a combustion air, said preheating device being formed as a component of said cover wherein said cover has a wall which faces toward the interior of the container and limits a combustion chamber, said wall being at least partially a component of at least one cooling passage for supplying substantially cold combustion air.

2. An arrangement as defined in claim 1, wherein said burner is formed as an air-fuel mixture burner.

3. An arrangement as defined in claim 1, wherein said wall is at least partially a component of a plurality of cooling passages for supplying substantially cold combustion air.

4. An arrangement as defined in claim 1, wherein said cover has a substantially circular horizontal projection.

5. An arrangement as defined in claim 1, wherein said cover has a central axis, said burner having a plurality of combustion air conduits and extending centrally and axially of said cover, said cover being provided with a fuel supply passage extending normal to said wall, at least one combustion air supply passage extending substantially in the axial region normal to said wall, cooling passages connected with said combustion air supply passage, an annular chamber provided at the periphery of said cover and communicating with said cooling passages, a heat exchanger chamber, and a plurality of heat exchanger pipes communicating said annular chamber with said combustion air conduits of said burner.

6. An arrangement as defined in claim 5, wherein said cover is provided with a plurality of such combustion air supply passages connected with said cooling passages.

7. An arrangement as defined in claim 5, wherein said heat exchanger pipes extend radially of said cover.

8. An arrangement as defined in claim 1, wherein said preheating device is subdivided into a plurality of segments.

9. An arrangement as defined in claim 5, wherein said cover has at least one waste gas inlet opening, a plurality of guiding sheets arranged substantially normal to said heat exchanger pipes, a waste gas outlet chamber formed above said heat exchanger chamber, and a waste gas outlet passage communicating with a peripheral region of said heat exchange chamber by said waste gas outlet chamber.

10. An arrangement as defined in claim 9, wherein said waste gas inlet opening is provided in the region of said axis of said wall.

11. An arrangement as defined in claim 9, wherein said guiding sheets are offset laterally.

12. An arrangement as defined in claim 9, wherein said guiding sheets are offset upwardly and downwardly.

13. An arrangement as defined in claim 9, wherein said waste gas outlet passage is arranged in the region of said center of said wall.

14. An arrangement as defined in claim 4; and further comprising a first pipe extending axially and centrally of said cover for fuel supply, and a second pipe coaxially surrounding said first pipe and having axially extending segment chambers in which said heat exchanger pipes are open and into which cold combustion air is supplied from above.

15. An arrangement as defined in claim 14, wherein said segment chambers are arranged in alternating order relative to one another in a circumferential direction.

16. An arrangement as defined in claim 4, wherein said heat exchanger pipes are composed of steel.

17. An arrangement as defined in claim 4, wherein said heat exchanger pipes are composed of copper.

18. An arrangement as defined in claim 4, wherein said cooling passages are provided on said wall and have spiral-like shape.

19. An arrangement as defined in claim 1, wherein said preheating device has a height and a width with relationship of between 1:1.5 and 1:3.5.

20. An arrangement as defined in claim 19, wherein the height and the width of the preheating device are selected in a relationship of substantially 1:2.

21. An arrangement as defined in claim 1, wherein said burner has a portion extending outwardly beyond said wall which limits the combustion chamber.

22. An arrangement as defined in claim 4, wherein said wall has a marginal region and is provided in said region with a shaped sealing member.

23. An arrangement as defined in claim 20, wherein said burner is a solid-matter burner; and further comprising means for separating ash and flue dust.

24. An arrangement as defined in claim 4, wherein said heat exchange chamber for the waste gas has a flow cross section which increases in a flow direction.

* * * * *